United States Patent [19]

Hofmann et al.

[11] 4,208,998

[45] Jun. 24, 1980

[54] FUEL INJECTION PUMP FOR INTERNAL COMBUSTION ENGINES

[75] Inventors: Eberhard Hofmann, Kirchberg; Reinhard Schwartz, Stuttgart; Berthold Wagner, Renningen, all of Fed. Rep. of Germany

[73] Assignee: Robert Bosch GmbH, Stuttgart, Fed. Rep. of Germany

[21] Appl. No.: 835,381

[22] Filed: Sep. 21, 1977

[30] Foreign Application Priority Data

Oct. 15, 1976 [DE] Fed. Rep. of Germany ..... 2646546

[51] Int. Cl.[2] ..... F02M 63/02

[52] U.S. Cl. ..... 123/139 AZ; 123/198 DB; 123/179 G; 123/139 B

[58] Field of Search ..... 123/139 AZ, 139 B, 139 ST, 123/139 AD, 142, 179 G, 179 L, 198 DB, 140 FG; 92/13.6, 13.8; 417/494, 499, 500

[56] References Cited

U.S. PATENT DOCUMENTS

| | | | |
|---|---|---|---|
| 862,867 | 8/1907 | Eggleston | 417/472 |
| 2,201,123 | 5/1940 | Davis | 123/198 DB |
| 2,645,474 | 7/1953 | Barnes | 123/198 DB |
| 2,719,521 | 10/1955 | King et al. | 123/198 DB |
| 2,918,040 | 12/1959 | Lieser | 92/130 R |
| 3,804,559 | 4/1974 | Staudt et al. | 123/139 B |
| 4,008,981 | 2/1977 | Bouquet | 417/499 |

FOREIGN PATENT DOCUMENTS

| | | | |
|---|---|---|---|
| 677525 | 6/1939 | Fed. Rep. of Germany | 123/139 L |
| 189447 | 3/1957 | Fed. Rep. of Germany | 417/494 |
| 1246641 | 9/1971 | United Kingdom | 123/139 ST |
| 1299678 | 12/1972 | United Kingdom | 123/139 AZ |

*Primary Examiner*—Leonard E. Smith
*Attorney, Agent, or Firm*—Edwin E. Greigg

[57] ABSTRACT

There is described a multicylinder fuel injection pump which is provided with a device that extends the length dimension thereof. The device includes a longitudinally shiftable piston disposed in a chamber that opens into the fuel injection pump. The shiftable piston includes perpendicularly disposed pin means arranged to cooperate with a fuel rack. In the rest position of the piston the regulating movements of the fuel rack caused by the governor are either unhindered because of the correspondingly long recess in the fuel rack, or limited to a predetermined travel path.

13 Claims, 3 Drawing Figures

FUEL INJECTION PUMP FOR INTERNAL COMBUSTION ENGINES

BACKGROUND OF THE INVENTION

This invention relates to a fuel injection pump for internal combustion engines and is particularly concerned with a multicylinder serial pump which includes cylinder sleeves inserted into the pump housing and a pump piston reciprocating in each cylinder sleeve. Each pump piston is adapted to be angularly adjusted for varying the effective delivery stroke by means of a longitudinally shiftable fuel rack which is supported exteriorly of the pump housng parallel to the longitudinal axis of the pump. In known fuel injection pumps of this type, the devices serving to cut off the supplied fuel are either integrated into the governor, or are attached to the front of the injection pump that faces the governor and usually act on the fuel rack through intermediate levers. These cut-off devices are actuated either manually or by an electromagnet, and require a corresponding structural space on the front side of the injection pump, which, for example with so-called flange pumps, whose pump housing is flanged directly onto the engine block, is not available, or which is already occupied by other devices, such as load pressure-dependent fuel limiters. In such assemblies there also results a structural lengthening of the pump, which can lead to mounting difficulties on the engine. If the adjusting device in existing governors or fuel limiters which are normally built onto the front sides of pumps, are built in, the end result is the requirement for a special model, which is very expensive and mechanically wasteful.

OBJECT AND SUMMARY OF THE INVENTION

Accordingly, it is the primary object of the invention to provide an arrangement wherein the control device for the fuel rack is mounted exteriorly of the fuel injection pump along the length dimension of the housing of the pump, thereby freeing the govrnor on its front side for the mounting of additional devices, such as load pressure-dependent fuel limiters and other control apparatus as well as also making it possible to easily mount a governor equipped with a spring slip member to the fuel rack.

A further object of the invention is to provide an arrangement wherein the device can, in addition, be produced for and used on a wide variety of types of pumps, which leads to a uniformity of the pumps and supplementary devices and to a greater number of the devices equipped according to the invention taught therein.

Another object of the invention is that by means of the direct engagement with the fuel rack, transfer members are economized and a safe cut-off is made possible.

Still another object of the invention is to be able to remove the device from the pump housing thereby revealing the window therein that can be used for functions such as for the mounting of a regulating travel path measuring device which is utilized durng examination of the pump and/or the governor.

A still further object of the invention is to provide a structure that is capable of being quickly removed from the fuel injection pump so that tests may be conducted.

Yet another object of the invention afforded by the use of the follower pin, which projects into the recess in the fuel rack through the window in the pump housing, is the simplified and inexpensive construction. By guiding the follower pin with the housing of the device, frictional forces on the fuel rack are avoided. Also, by using a pressure medium, preferably motor oil or fuel, an extremely small embodiment of the adjusting piston diameter is possible because of the pressures present, thus the device can be formed very compact. In addition, in a further embodiment of the invention an elactromagnet can serve as a supplementary force.

The invention will be better understood as well as further objects and advantages thereof become more apparent from the enusing detailed description taken in conjunction with the drawings.

DESCRIPTION OF THE PREFERRED EMBODIMENT

Figure 1:
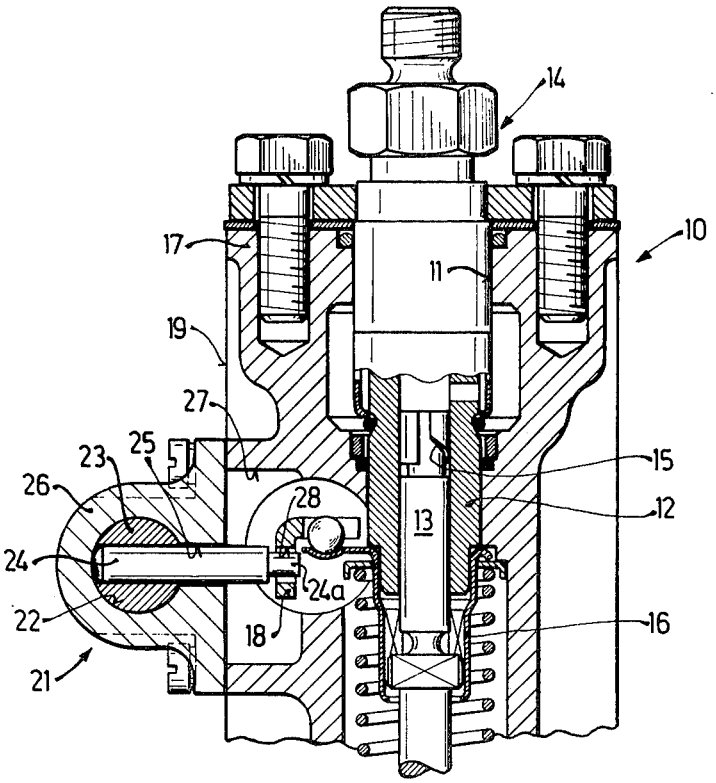
FIG. 1 is a cross-sectional view on an enlarged scale of the fuel injection pump of this invention.
Figure 2:
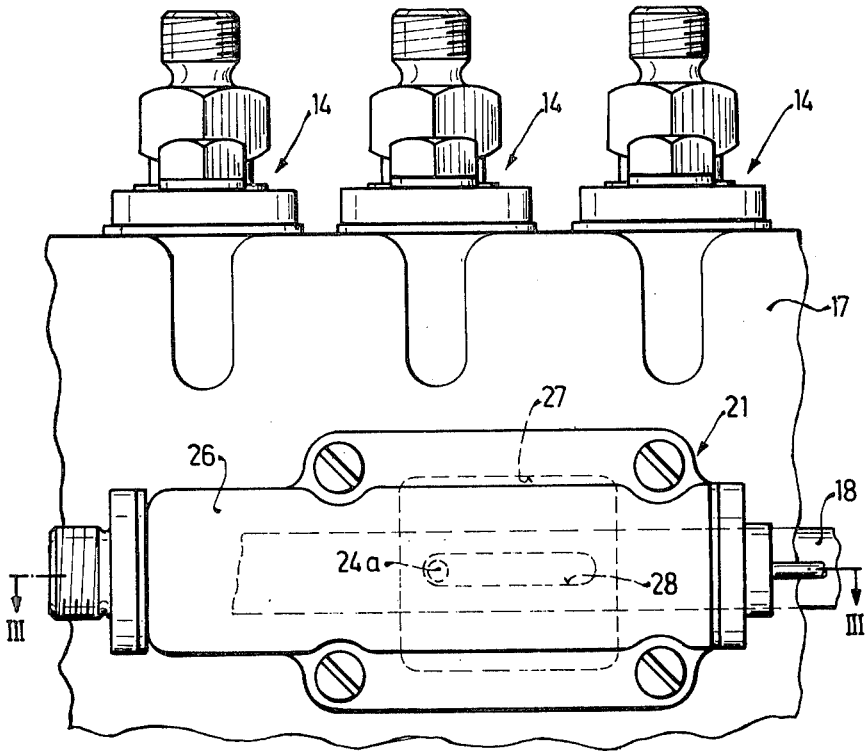
FIG. 2 is a partial sectional view showing the improved device mounted on the side of a pump; and in the direction of the arrow II in FIG. 1.

Turning now to FIGS. 1 and 2, in an only partially shown pump housing 17 of a multicylinder serial injection pump 10 there are provided a plurality of parallel spaced mounting bores 11. In each there is inserted a cylinder sleeve 12, in the cylinder bore of which there is disposed a slidable pump piston 13 provided with an oblique control edge 15. Each pump piston 13 is, in a known manner, angularly adjustable by means of a longitudinally shiftable fuel rack 18 for altering the effective delivery stroke, said fuel rack 18 being axially movable in the pump housing 17. It will also be noted that the pump pistons 13 of the injection pump 10, which are provided with slanted control surfaces 15, in a known manner, are rotated by regulating sleeve 16 to change the effective fuel supply stroke. In this manner one end of the fuel rack 18 can be activated by a governor which is not shown here in detail.

On one longitudinal side as at 19 of the pump housing 17 is attached a control device 21 that is disposed adjacent to the fuel rack 18, this device being arranged to include in a housing 27 an axial bore 22 within which is positioned an adjusting piston 23 that is parallel to the fuel rack 18. A follower pin 24 is received in a bore in the adjusting piston 23 which is disposed perpendicular to its long axis and serves as a follower member. This follower pin 24 projects through an elongated slot-way 25 in the housing 26 of the control device 21, and is guided therein for reciprocal movement. The follower pin 24 projects through a window 27 provided in the pump housing 17 and a stud end 24*a* engages with an oval shaped hole or operture 28 provided in the fuel rack 18.

Figure 3:
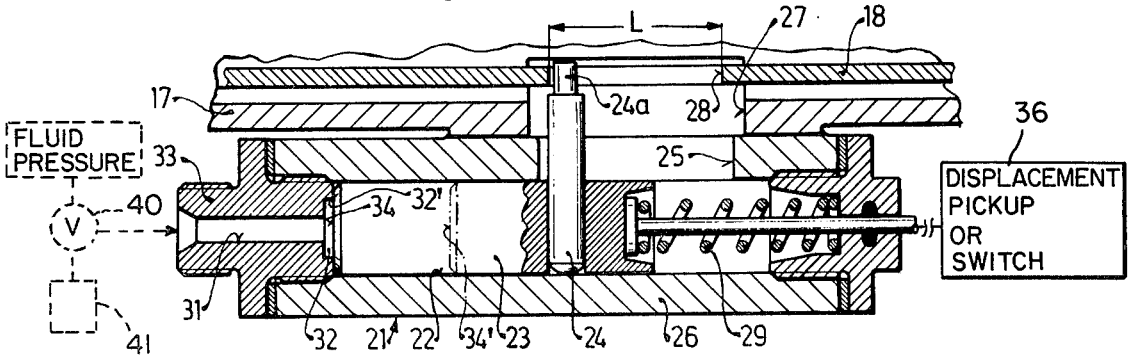
FIG. 3 is a cross-sectional view along the line III—III in FIG. 2.

As shown by a broken line in FIG. 2, the aperture 28 has a length L, which is the position of rest as seen clearly in FIG. 3, the adjusting piston 23 thus allows an unhindered actuation of the fuel rack 18 by the governor or by service personnel. With further reference to FIGS. 2 and 3, the fuel rack 18 is in its stopping position and the length L of the recess 28 allows a movement of the fuel rack 18 to the left, as viewed in the drawing, until it reaches its maximal possible setting, which is normally the starting position, but also can be the full-load position.

As shown in FIG. 3, the adjusting piston 23 is held in its rest position by a return spring 29, against the force of which the adjusting piston 23 can be actuated by a pressure medium which serves as a supplementary force, with said medium being fed through a connecting bore 31 into a pressure chamber 32. Motor oil or fuel from the injection pump preferably serves as the pressure medium, but air pressure can be also used.

The introduction of the pressure medium is controlled in a known manner either manually or automatically by means of a control valve 40 for associated operational values. Further, the control device 21 can be employed together with an associated circuit as a security device, which is activated as an emergency cut-off device if any important operational value fails for any reason.

In FIG. 3 the nipple 33 comprises a pressure chamber 32 which communicates with a connecting bore 31. The pressure chamber more particularly includes the recess 32' in the nipple and the end wall 34 of the adjusting piston 23. Thus, as the pressure medium pushes the adjusting piston 23 to the right, the chamber area is increased by including part of the long bore 22 in the housing 26 of the control device 21. The furthest right position, as viewed in the drawing, of the adjusting piston 23, where it is pushed against the force of the return spring 29, and where the adjusting piston 23 moves the fuel rack 18 into its stopping position, is defined by the front side 34', which is shown as a broken line in FIG. 3.

In the present exemplary embodiment the nipple 33 also serves as a travel block to limit movement of the adjusting piston 23 to the left as viewd in the drawing. An adjustable stop could be also used, by means of which the adjusting piston 23 is set in a position, which determines the maximal regulating position of the fuel rack 18 that is only schematically shown in FIG. 3. This stop can also be formed so as to be automatically controllable, for example, by means of a thermo-responsive element. The opposite end of the adjusting piston 23 is arranged to receive a suitable force applying means 35. The force applying means 35 enters an aperture in a closure member and the return spring 29 is interposed between the inner wall of the closure member and a cavity in the piston 23. The force applying means 35 can be connected to a displacement pickup or switch 36. The force applying means 35 can also be used for the manual actuation of the adjusting piston 23 when it is firmly affixed to the adjusting piston 23. Thus, for example, a Bowden wire which is actuatable either manually or by means of an electromagnet, can be utilized.

The introduction of a pressure medium through the nipple 33 which may serve as a supplementary force as well as the possible actuation by the force applying means 35, together with the control device 21 being located near the fuel rack 18 of the pump, make possible a space-saving attachment for assmebly with the pump, since further necessary control valves and actuating members can be located where they are easier to install for reasons of space or load.

In the illustrated embodiment of the adjusting piston 23, which can be actuated by a pressure medium, the return spring 29 is capable of moving the piston 23 into its rest position as shown in FIG. 3, where the maximum regulating path of the fuel rack 18 is free, so that when the internal combustion engine is operated the greatest possible starting quantity is immediately available. This occurs when the internal combustion engine is shut off and the pressure of the pressure medium falls off.

In principle, an alternative functioning of the adjusting piston 23 is possible, whereby the return spring 29 presses the piston 23 into its stopping position and the pressure medium moves the piston 23 into its rest position shown in FIG. 3. In this case the release of the starting quantity of fuel would be dependent on the build-up of the supplementary force, i.e., the adjusting force introduced by means of the force applying member 35.

If the control valve used in the shown embodiment in the FIGS. 1 through 3 for controlling the motor oil pressure and fuel pressure serving as a supplementary force is so switched that it permits the inflow of the pressure medium to the pressure chamber 32 when the electrical current fails, then this device serves as a safety device and a hindrance to keep the motor from speeding up, because, when the electrical apparatus is not actuated, a magnet 41 remains in the position where it holds open the hydraulic supply to the pressure chamber 32, so that the rising oil pressure caused by the increasing engine speed pushes the adjusting piston 23 immediately back into the position which causes the fuel rack 18 to go to the engine stop position against the force of the spring 29.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump comprising:

a housing within which a plurality of aligned cylinder bores are formed and in one wall of which an opening is formed;

a plurality of pistons, one for each cylinder bore, said pistons being mounted in their respective cylinder bore for reciprocal and rotary movement;

a longitudinally displaceable fuel rack within which a recess is formed;

means connecting the fuel rack with each piston for effecting a partial rotation of each piston in its cylinder upon longitudinal displacement of the fuel rack for the purpose of changing the effective delivery stroke of each of the pistons; and a control device including a longitudinally displaceable adjusting piston which extends substantially parallel to the fuel rack, and a follower pin which extends between the adjusting piston and the fuel rack, said follower pin passing through said opening in the housing and into the fuel rack recess, said adjusting piston being longitudinally displaceable by a controlled supplementary force, with said displacement being transmitted to the fuel rack by the follower pin, wherein said recess has a longitudinal length such that the fuel rack can be adjusted independently of the control device.

2. The fuel injection pump as defined in claim 1, wherein the follower pin is firmly connected to the adjusting piston at a right angle to the longitudinal axis of the adjusting piston.

3. The fuel injection pump as defined in claim 1, wherein the control device further includes a control housing within which the adjusting piston is displaced, and a slot-way formed in said control housing which is aligned with the opening in said pump housing and the recess in said fuel rack, and wherein the follower pin extends through said slot-way and opening into said recess.

4. The fuel injection pump as defined in claim 1, further comprising an electromagnet for producing the controlled supplementary force.

5. The fuel injection pump as defined in claim 1, further comprising:

a control valve which controls a pressure medium, said pressure medium producing the controlled supplementary force, and wherein the control device further includes a return spring which acts against the adjusting piston to oppose the controlled supplementary force and biases the adjusting piston toward a rest position.

6. The fuel injection pump as defined in claim 5, wherein the return spring moves the adjusting piston into its rest position when the controlled supplementary force is sufficiently reduced, at which the full longitudinal length of the recess is available for movement of the fuel rack.

7. The fuel injection pump as defined in claim 6, wherein the rest position of the adjusting piston determines the starting position or the full load position of the fuel rack.

8. The fuel injection pump as defined in claim 7, wherein the control device further includes manually controlled stop means which adjusts the rest position of the adjusting piston.

9. The fuel injection pump as defined in claim 7, wherein the control device further includes stop means automatically controlled by an operational value of the engine, said stop means serving to adjust the rest position of the adjusting piston.

10. The fuel injection pump as defined in claim 1, wherein the control device further includes a control housing within which the adjusting piston is displaced, and a force applying means which projects through the control device housing and is connected to the adjusting piston.

11. The fuel injection pump as defined in claim 10, further comprising:

a displacement pickup, and wherein the force applying means connects the adjusting piston with the displacement pickup.

12. The fuel injection pump as defined in claim 10, further comprising:

a switch, and wherein the force applying means connects the adjusting piston with the switch.

13. The fuel injection pump as defined in claim 10, wherein the adjusting piston is manually adjusted by the force applying means.

* * * * *